US007309051B2

(12) United States Patent
McNeill

(10) Patent No.: US 7,309,051 B2
(45) Date of Patent: Dec. 18, 2007

(54) HEIGHT ADJUSTABLE SUPPORTS FOR TABLE TOPS AND LIKE FIXTURES

(76) Inventor: Donald McNeill, 22 Sprucewood La., Ridgefield, CT (US) 06877-2520

( * ) Notice: Subject to any disclaimer, the term of this patent is extended or adjusted under 35 U.S.C. 154(b) by 0 days.

(21) Appl. No.: 11/251,476

(22) Filed: Oct. 14, 2005

(65) Prior Publication Data

US 2007/0084980 A1 Apr. 19, 2007

(51) Int. Cl.
*F16M 11/24* (2006.01)

(52) U.S. Cl. ..... 248/188.2; 248/188.1; 248/188.5; 108/144.11; 108/147.11; 108/147.13

(58) Field of Classification Search ..... 248/125.8, 248/188.2, 188.5, 346.01, 161, 157, 423, 248/188.1; 108/144.11, 147.11, 147.12, 108/147.13, 147.14, 147.15, 147.21, 106, 108/110

See application file for complete search history.

(56) References Cited

U.S. PATENT DOCUMENTS 1,013,231 A * 1/1912 Stearns ..... 190/18 R
3,428,147 A * 2/1969 Gordon ..... 182/204
3,478,993 A * 11/1969 Wyeroski et al. ..... 248/245
3,875,712 A * 4/1975 Thompson ..... 52/263
4,156,332 A * 5/1979 Thompson ..... 52/165
4,423,797 A * 1/1984 Batten ..... 182/204
4,644,713 A * 2/1987 Lehman ..... 52/165
5,325,936 A * 7/1994 Baker ..... 182/204
5,887,842 A * 3/1999 Granger ..... 248/548
6,682,030 B2 1/2004 Santoro et al. ..... 248/188.5
6,823,802 B2 11/2004 Butts ..... 108/25
6,848,370 B1 2/2005 Stanford ..... 108/132

* cited by examiner

*Primary Examiner*—Amy J. Sterling

(57) ABSTRACT

The invention provides a height adjustable support or leg assembly for a table or similar object, said assembly having two components, an L-shaped inner leg and a square outer leg constructed to create a perfect fit between them using means for adjusting the height of the assembled unit. The height adjustment means consists of a plurality of holes bored in the outer component and T-nut studs to connect the legs together at specific height adjustment and to secure the components together firmly and safely.

3 Claims, 7 Drawing Sheets

HEIGHT ADJUSTABLE SUPPORTS FOR TABLE TOPS AND LIKE FIXTURES

FIELD OF INVENTION

The present invention relates to the field of height adjustable legs for supporting table tops or like objects, and more specifically to children's play tables, house fixtures or office furniture. There are numerous applications requiring one or more adjustable height supports or legs for supporting a table top or like objects. Such supports or legs are known in many embodiments, for example, in integral part of tables, in home furniture such as portable expandable coffee tables, in office furniture such as movable expandable tables used for placing office equipment on or in construction industry for use on site to support blueprint plans, technical drawings and other information. The design of the present invention is unique in that each leg consists of two components, an inner leg and an outer leg constructed to fit the inner leg and be fastened firmly to it. The height adjusting means is integrated between the inner and outer legs. The design may be adapted for use in any objects requiring adjustment in height.

BACKGROUND TO THE INVENTION

Prior art height adjustable supports or legs are unsuited for applications described herein in that they are constructed to adjust an individual leg to a number of height positions by having holes mounted at several heights in the inner leg, or in the inner and outer leg opposite each other, through which a pin can be stuck at the desired height or the outer leg contains a spring-based locking means which is intended for engaging a complementary locking means mounted in the inner leg. Although such systems function adequately, they do not provide an adequate and safe design for use in children's adjustable height play tables.

SUMMARY OF THE INVENTION

The present invention provides a height adjustable support or leg (or legs) for a table or object, said height-adjustable support or leg (legs) consisting of two components, an L-shaped inner fixed leg and a square shaped outer adjustable leg constructed to fit and be fastened firmly to the inner leg, each of said components having means for height-adjustment of the support or leg (legs) that is safe, stylish and suitable for use in children's' play tables and other support embodiments requiring height adjustment.

The object of the invention is to provide height-adjustable support or leg (legs) in which the means height-adjustment of the support or leg (or legs) do not protrude from the support or legs, that they can be operated in a convenient and simple way and furthermore be manufactured at relatively low cost.

Accord to the invention, each support or leg consists of two components, an L-shaped inner leg that is fixed and a square shaped outer leg (in cross-section) that is adjustable, constructed so that the square outer leg nestles to the interior side of the L-shape of the inner leg, wherein the means of adjusting the height are used to firmly fasten the inner and outer legs.

Thus according to the preferred embodiment the means of adjusting the height of the support or legs include a plurality of holes suitably bored at the top end and adjustable at the bottom end of the outer leg. The inner L-shaped includes a plurality of holes spaced such that there is enough space that is unperforated in the inner fixed leg to allow attachment of cross supports.

The locking means for fastening the inner and outer legs at a selected height consists of T-nut studs having an interior threaded insert and exterior threads suitable for screwing into materials such as wood, plastic, or metal. The T-stud holes in the outer leg are bored to a depth that prevents the wings of the T-studs from contacting the surface of the legs, and thus difficult to remove.

BRIEF DESCRIPTION OF THE DRAWINGS

Other advantages of the invention will become apparent from a study of the following specification when viewed in light of the accompanying drawings, in which.

DETAILED DESCRIPTION OF THE INVENTION

Figure 1:
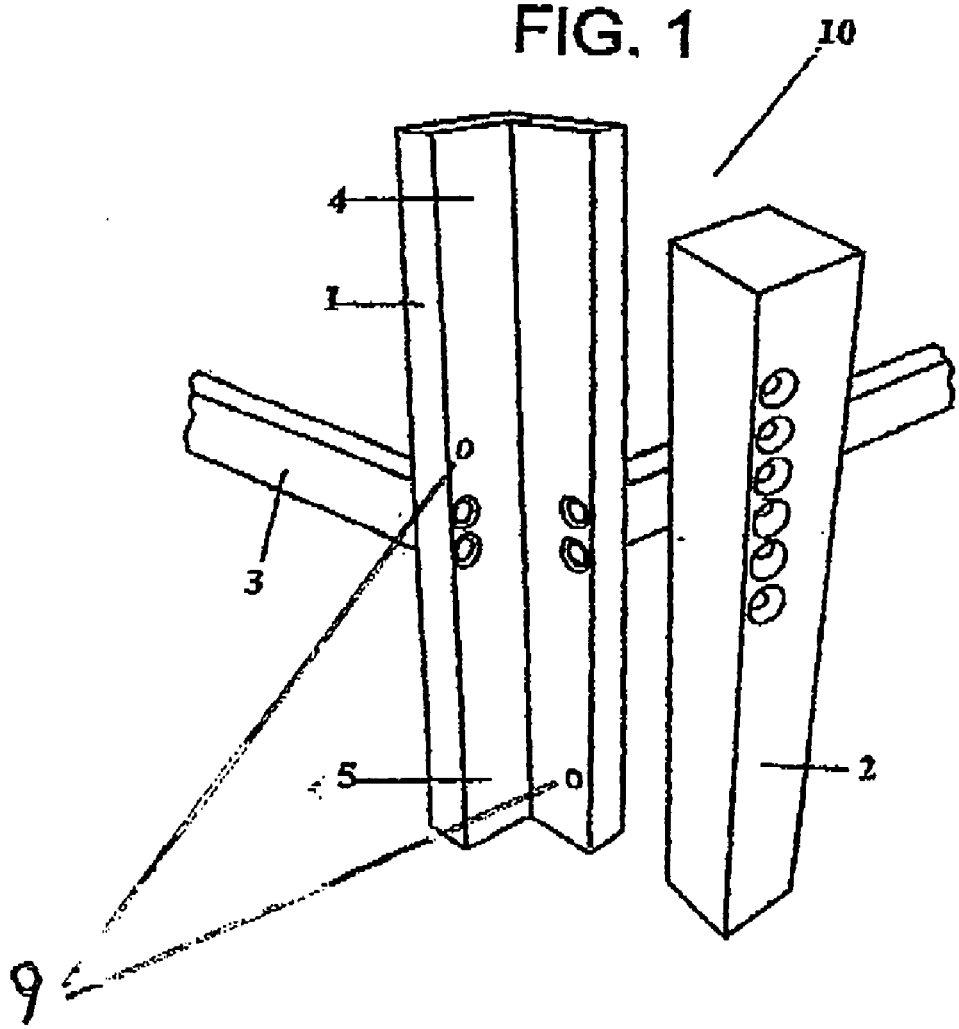
FIG. 1 shows the perspective view of the preferred embodiment of an L-shaped fixed inner leg attached to cross-members, and the corresponding square-shaped outer adjustable leg.

Referring to FIGS. 1 to 9, a preferred (10) embodiment of a support or leg for a table or object (9) according to the invention comprises an assembly of two components, an L-shaped leg inner fixed and a square outer adjustable leg (2) constructed to fit the leg (1), the inner fixed leg (1) has cross-members (3) attached to it midway, and includes a means of securely fixing the top of a table (9) or other such object at the top end (4) of the inner leg (4), with the bottom end (5) being used for placement on the floor or other suitable flat surface.

Height-adjustable "leg" as used herein represents supports in the shape of conventional legs for a table, or any support structures that may be adjustable in height, and may be used in fixtures for other uses besides supporting a weight bearing object.

FIG. 1 Illustrates a fixed inner leg (1) with an L-shaped cross-section and an adjustable outer leg (2) with a square-shaped cross-section. Optionally attached to each outer side of the inner leg (1) are cross members (3) which connect to the adjacent inner legs (1) providing added lateral strength to the table assembly. The method used to attach the cross member (3) to the inner leg (1) is to counter bore a hole (or holes) of proper diameter and depth beginning on the interior side of the inner leg (1), thus allowing the fastener when inserted into the cross member (3) and inner leg (1) and tightened to be seated beneath the interior surface of the inner leg (1), enabling the outer leg (2) to slide unobstructed along the surfaces of the interior sides of the inner leg (1). The outer adjustable leg (2) has on it drilled and counter bored a plurality of holes (7) which are placed at suitable intervals, to allow a t-stud (8) to pass through the outer leg (2) and screw into a wood insert (9) having both exterior and interior threads, thereby firmly attaching the outer leg (2) to the inner leg (1). The T-stud holes (7) are counter bored to a depth in the outer leg (2) to prevent the wings of the T-studs (8) from contacting the surface of the legs, and provides a surface for the base of the T-stud handle to press firmly against.

Figure 2:
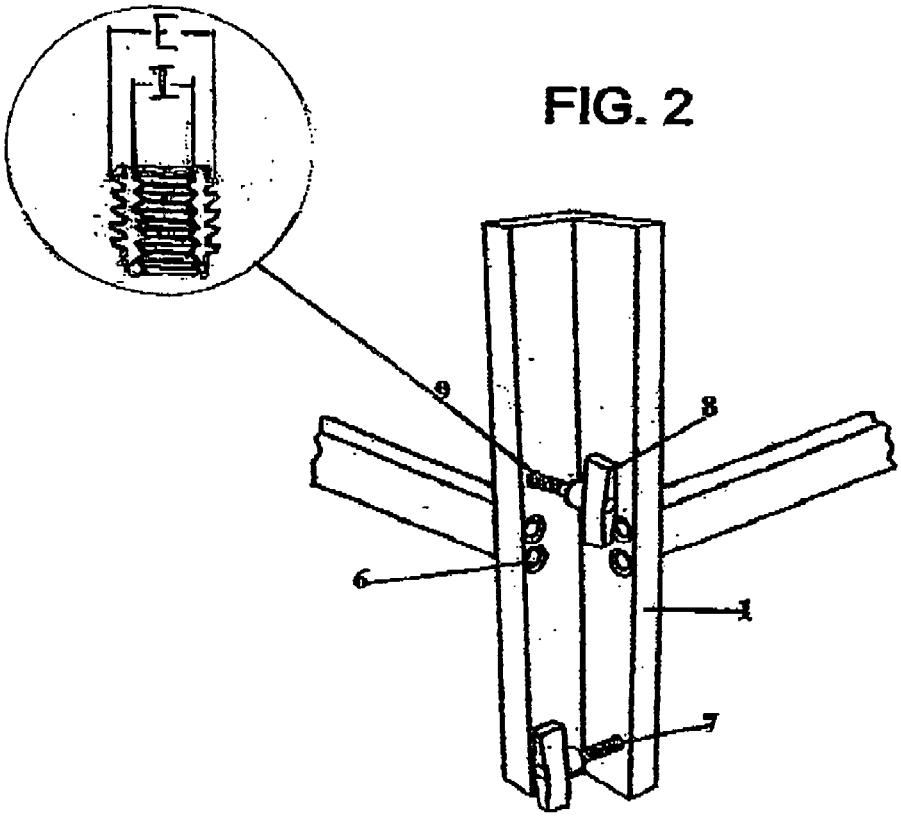
FIG. 2 illustrates the T-nut stud screwed into the L-shaped inner leg.

FIG. 2 describes in detail the inner leg component (1) of the support assembly (10), in which it becomes clear how the T-stud screws into the wood insert (9), which in turn is firmly screwed into the fixed inner leg (1).

Figure 3:
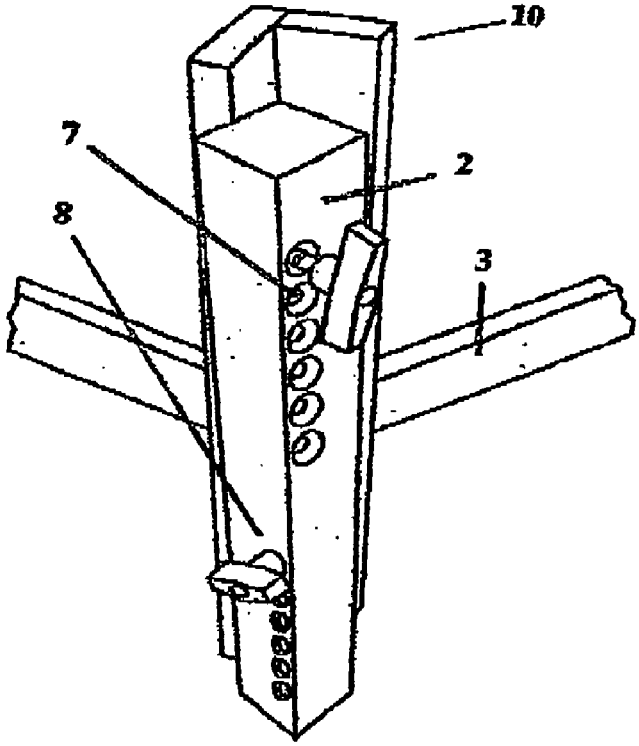
FIG. 3 is a perspective view of the L-shaped inner fixed leg and the square shaped outer adjustable leg in position for assembly.
Figure 4:
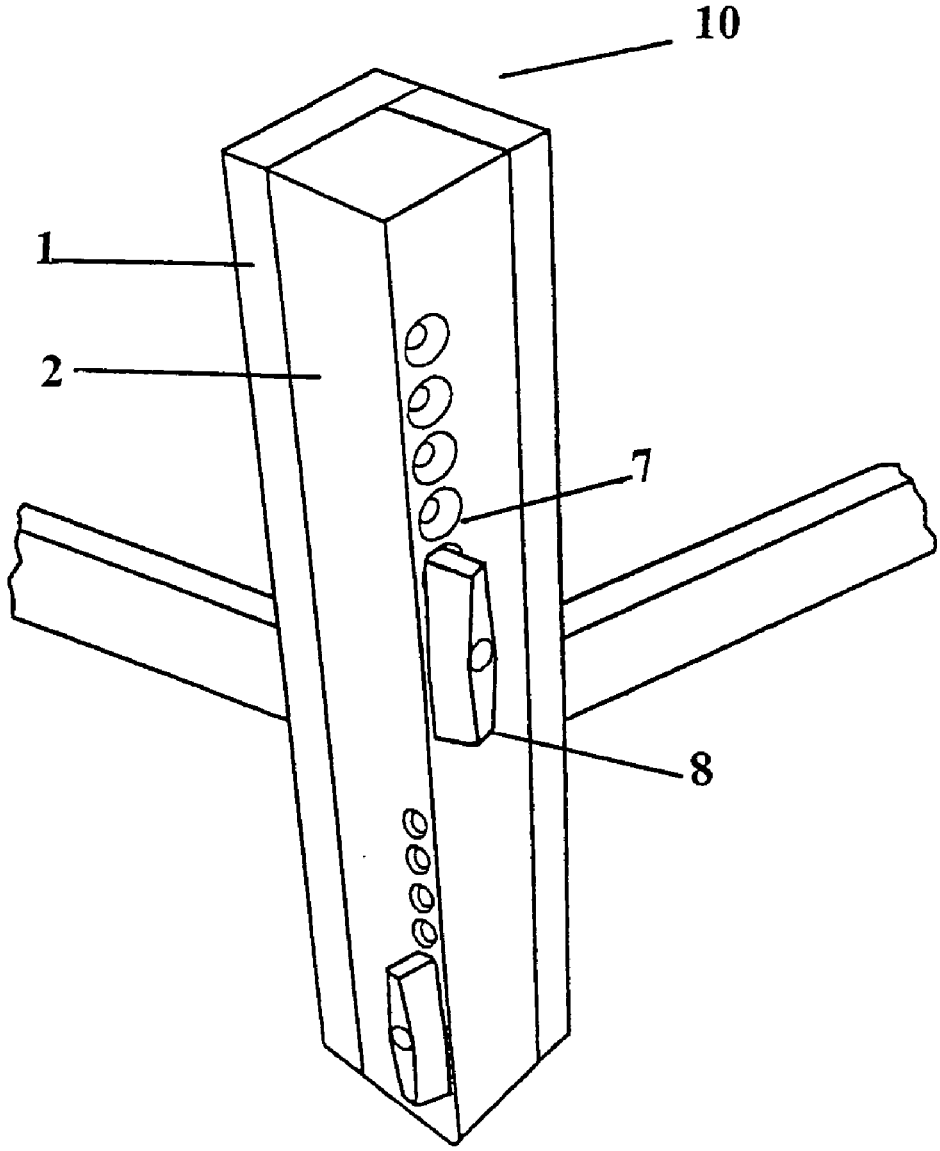
FIG. 4 is a side-view of the inner and outer legs firmly assembled without height adjustment.

FIG. 3 demonstrates all components of the assembly (10) that are ready for assembly including the inner leg with cross members (7) attached to it and the outer leg with the T-stud holes and T-stud in place for screwing.

FIG., 4 illustrates an embodiment of the support assembly (10) in which the inner leg (1) and the outer leg (2) are attached without any height adjustment as is evident from the fact that the upper (11) and lower ends (12) of the inner leg (1) are aligned and firmly attached to respective ends of the outer leg (2). The inner fixed leg (1) may also be used on its own without the outer leg (2). Both sides of the inner fixed leg are equal in width. The L-shaped (in cross-section) of the inner fixed leg (1) allows for the immovable perfect fit in relation to the square-shaped (in cross-section) adjustable leg (2) to the inner leg (1).

Figure 5:
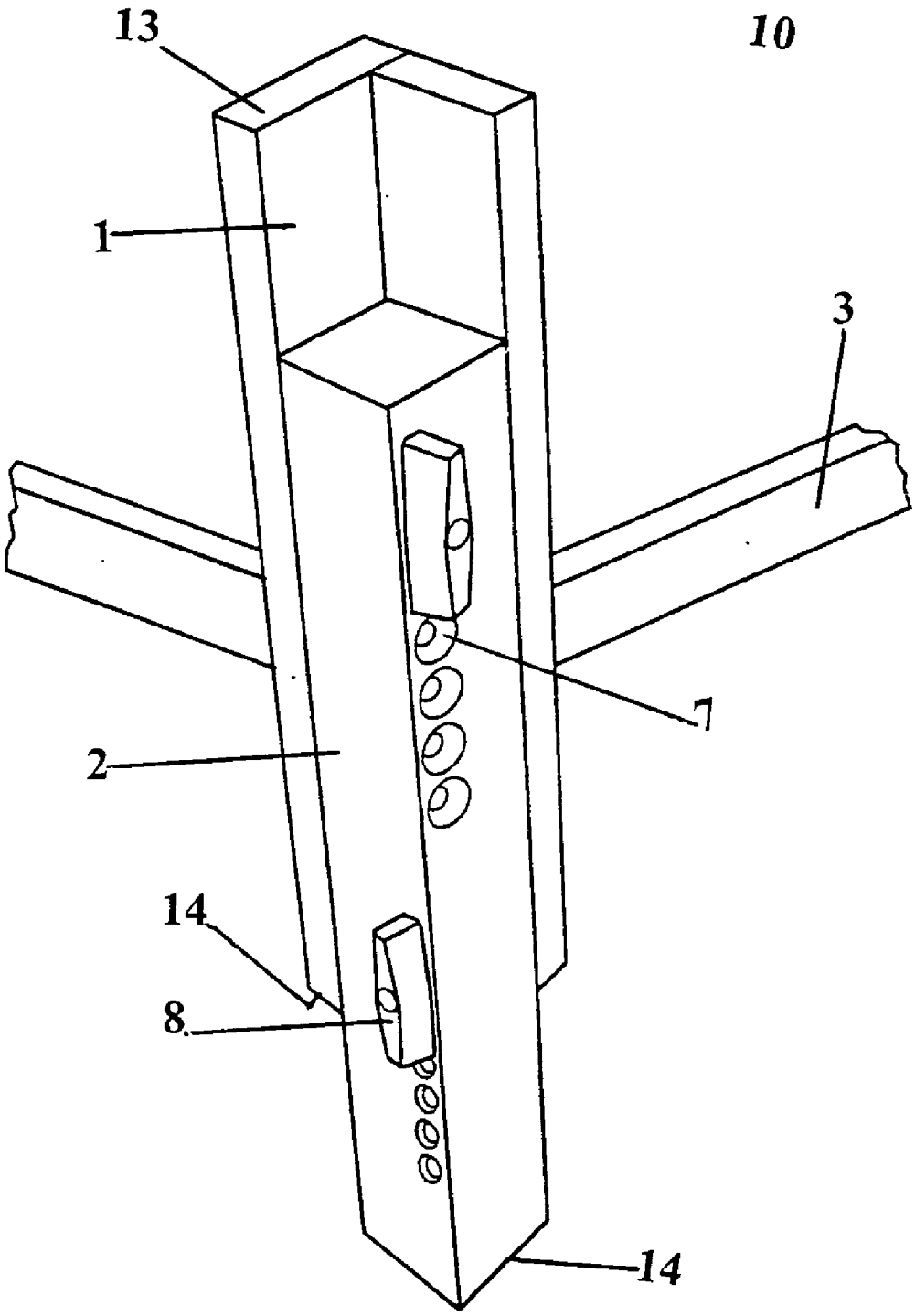
FIG. 5 illustrates the outer square shaped leg positioned at a maximum height.

FIG. 5 demonstrates an embodiment of the support assembly (10) when it is assembled at the maximum height. There are two sets of bored holes (6) and T-studs shown. Each of the support assembly (10) is put together by adjusting the height and screwing the T-studs (8) tightly. For a table needing four legs, all four support assemblies are fixed to the inner side of the table top by using suitable fixing means which are installed at the top ends (13) of the inner legs (1). Both the inner and outer legs have floor engaging bottom ends (14). The resulting height adjusted supports provide support and stability for the table.

Figure 6:
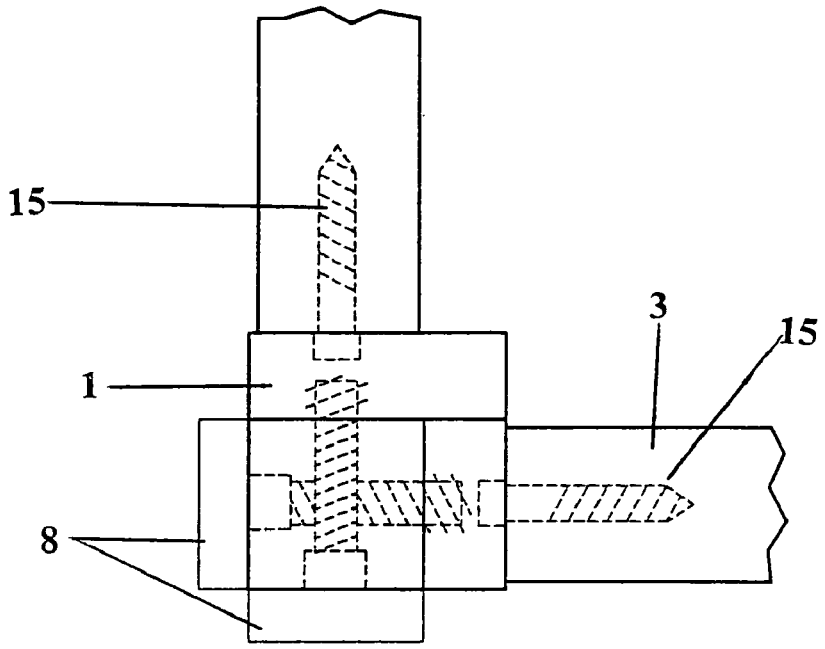
FIG. 6 illustrates a T-nut stud passing through the adjustable outer square leg towards the L-shaped inner fixed leg.

FIG. 6 describes a cross-section view of the T-stud (8) passing through the holes (6) in the outer leg and fastening to the double threaded wood inserts (9) in the inner fixed leg. Also shown are cross members (3) fastened to the inner fixed leg by fasteners (15). In this embodiment, the fixed leg (1) has been drilled and counter bored to allow the fastener (15) in the cross-member (3) to sit below the inner-leg's (1) surface to permit the adjustable leg (2) to move freely along the surface of the inner leg (1).

Figure 7:
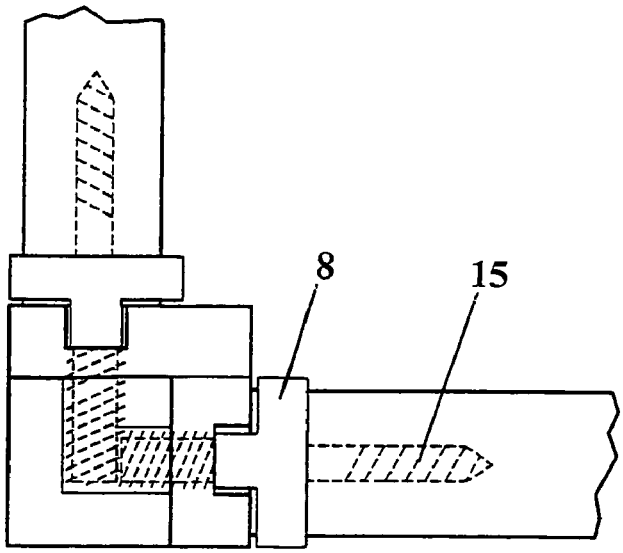
FIG. 7 illustrates a different embodiment of the T-nut stud.

FIG. 7 is another embodiment in which the T-stud (8) passes through the inner fixed leg (1) into the outer leg (2). This embodiment requires an insert (9) in every hole of the adjustable leg. The studs (8) are less accessible when passing through the fixed inner leg (1).

Figure 8:
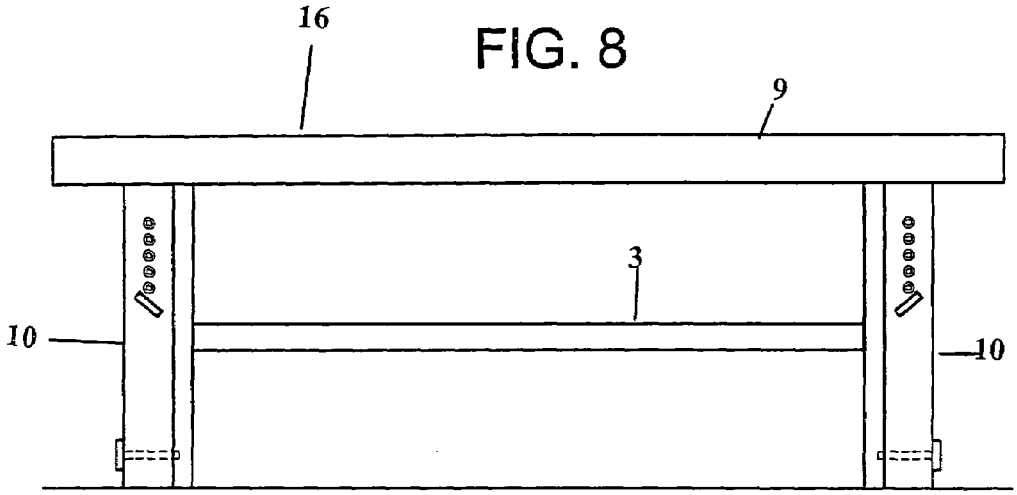
FIG. 8 is a perspective of a table supported by the adjustable legs fitted at the lowest setting.
Figure 9:
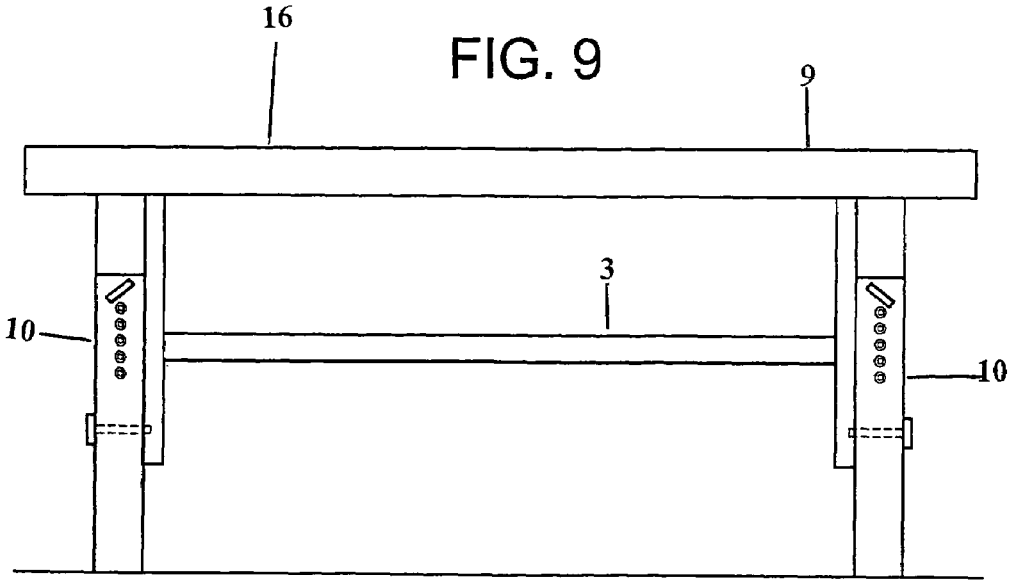
FIG. 9 is a perspective of a table supported by the adjustable legs fitted at the highest setting.

FIGS. 8 and 9 show embodiments (16) that use the adjustable supports or legs of the invention in which the object to be supported is a table (9) top. FIG. 8 illustrates the adjustable supports or legs set at the lowest setting for height. FIG. 9 illustrates an embodiment for the highest setting for height.

While the preferred forms and embodiments of the invention have been illustrated and described, it will be apparent to those of ordinary skill in the art that various changes and modifications may be made without deviating from the inventive concepts set forth above.

What is claimed is:

1. A height adjustable leg assembly including an inner and outer leg and a height adjustment means connected to said inner and outer legs, the improvement comprising:

A leg assembly including an inner leg an L-shaped cross-section having two internal faces, and an outer leg with a square shaped cross-section having two internal faces and two external faces, wherein the internal faces of the inner leg mate with the external faces of the outer leg structured to assemble in a perfect fit relation, said inner leg containing a plurality of holes drilled at suitable intervals and said outer leg having drilled on it a plurality of counter bores at suitable intervals, wherein the bores are drilled on the two outer faces of the outer leg and extend therethrough, and a height adjustment means including a screw that passes through the outer leg outer faces to a depth and screws into a wood insert which has both exterior and interior threads, said wood insert being located in a hole on the inner face of the inner leg, the adjustment means used to attach the outer leg to the inner leg in a perfect fit, wherein the outer leg is drawn to the inner leg forming a combined cross-section of a square shape.

2. The height adjustable leg assembly of claim 1 wherein the inner leg further contains a plurality of counter bores to provide a smooth continuous surface for the outer leg to travel during adjustment, wherein a cross member is attached with a suitable fastener thereby eliminating any horizontal effort to provide stops at different heights.

3. The height adjustable leg assembly of claim 2, wherein the inner leg contains at the top end a suitable fixing means to securely attach to an object requiring height adjustment.

* * * * *